US011910945B1

(12) United States Patent
Connolly

(10) Patent No.: US 11,910,945 B1
(45) Date of Patent: Feb. 27, 2024

(54) TOP FLAT SHEET AND BOTTOM FITTED SHEET COMBINATION

(71) Applicant: Michael Connolly, Dallas, TX (US)

(72) Inventor: Michael Connolly, Dallas, TX (US)

( * ) Notice: Subject to any disclaimer, the term of this patent is extended or adjusted under 35 U.S.C. 154(b) by 771 days.

(21) Appl. No.: 17/079,573

(22) Filed: Oct. 26, 2020

Related U.S. Application Data

(63) Continuation-in-part of application No. 29/751,863, filed on Sep. 23, 2020, now Pat. No. Des. 983,569.

(51) Int. Cl.
*A47G 9/02* (2006.01)
*A47G 9/00* (2006.01)

(52) U.S. Cl.
CPC ..... *A47G 9/0246* (2013.01); *A47G 9/0223* (2013.01); *A47G 2009/004* (2013.01)

(58) Field of Classification Search
CPC ..... A47G 9/0246; A47G 9/0223; A47G 2009/004; A47G 9/0238
See application file for complete search history.

(56) References Cited

U.S. PATENT DOCUMENTS 7,231,679 B2 * 6/2007 Ho ..... A47G 9/0238 5/500
7,290,301 B2 * 11/2007 Ho ..... A47G 9/02 5/500
7,487,561 B2 * 2/2009 Ho ..... A47G 9/02 5/500
8,151,386 B2 * 4/2012 McKee ..... A47G 9/02 5/500
8,464,377 B1 * 6/2013 Carson ..... A47G 9/0261 24/72.5
8,522,378 B2 * 9/2013 Argento ..... A47G 9/02 5/482
8,898,834 B1 * 12/2014 Huber ..... A47C 31/105 5/482
9,549,625 B1 * 1/2017 Wilkinson ..... A47G 9/0223
D778,638 S 2/2017 Williams
D983,569 S * 4/2023 Connolly ..... D6/602
2007/0101496 A1 * 5/2007 Ho ..... A47G 9/02 5/482
2007/0113341 A1 * 5/2007 Ho ..... A47G 9/0238 5/497
2007/0118988 A1 * 5/2007 Ho ..... A47G 9/02 5/497

(Continued)

FOREIGN PATENT DOCUMENTS

CA 2814264 A1 * 7/2013 ..... A47G 9/02
WO WO-2019222528 A1 * 11/2019 ..... A47C 21/022

*Primary Examiner* — Robert G Santos
(74) *Attorney, Agent, or Firm* — Michael Diaz

(57) ABSTRACT

A bed linen combination for use on a mattress. The combination includes a bottom fitted sheet having a first side, an opposing second side, a top edge and a foot-end which is sized and shaped to fit over the mattress. The combination also includes a top flat sheet attached to the bottom fitted sheet at the foot-end and a portion of the first and second sides of the bottom fitted sheet at first and second side attachment segments. Tags may also be affixed at the ends of the side attachment segments to the top flat sheet and bottom fitted sheet. In another embodiment of the present invention, a blanket may be magnetically held in place at the foot-end of the top flat sheet and bottom fitted sheet.

8 Claims, 7 Drawing Sheets

(56) References Cited

U.S. PATENT DOCUMENTS

| | | | | |
|---|---|---|---|---|
| 2009/0044337 | A1* | 2/2009 | McKee | A47G 9/02 5/496 |
| 2012/0246828 | A1* | 10/2012 | Argento | A47G 9/02 5/486 |
| 2014/0013510 | A1* | 1/2014 | Mcaleney | A47G 9/02 5/495 |

* cited by examiner

TOP FLAT SHEET AND BOTTOM FITTED SHEET COMBINATION

CROSS-REFERENCE TO RELATED APPLICATIONS

This application is a continuation of U.S. application Ser. No. 29/751,863, filed Sep. 23, 2020, the entire disclosure of which is hereby incorporated herein by reference.

BACKGROUND OF THE INVENTION

Field of the Invention

This invention relates to bed linen. Specifically, and not by way of limitation, the present invention relates to a combined top flat sheet and bottom fitted sheet for a bed.

Description of the Related Art

Typically, two types of bed sheets are used for bedding. A top sheet or flat sheet is commonly a rectangular sheet of cloth which is sized and shaped to fit over a rectangular bed. The bottom sheet is a fitted sheet having ends that are elasticated and shaped to fit tightly over a mattress. The fitted bottom sheet is configured to avoid slipping off the mattress while the bed is being used. Although this bedding configuration has been used for decades, there are problems associated with using the two separate sheets. First, as the sheets have to be regularly laundered, the sheets must be repeatedly removed and then put on over a mattress. Since there are two separate sheets, the process involves first positioning the fitted bottom sheet over the mattress and then separately placing and tucking the top flat sheet over the fitted sheet and underneath the mattress. Additionally, because the sheets are separate, the top flat sheet, since it is not held in place with elastic, tends to be pulled off or skewed on the bed when in use.

There are some existing bedding where a top flat sheet is attached to a bottom end (or foot end) of a fitted sheet. However, these existing connect sheets do not provide any attachment mechanism on any portion of the sides of the fitted sheet or provide any indication on the proper orientation of the dual sheet combination when placing on a bed. It would be advantageous to have bedding which is attached in such a manner which enables a secure attachment of the top flat sheet to the bottom fitted sheet while providing an indicator on properly orientation when placing the bedding on a bed. It is an object of the present invention to provide such bed linen.

SUMMARY OF THE INVENTION

In one aspect, the present invention is directed to a bed linen combination for use on a mattress. The combination includes a bottom fitted sheet having a first side, an opposing second side, a top edge and a foot-end which is sized and shaped to fit over the mattress. The combination also includes a top flat sheet attached to the bottom fitted sheet at the foot-end and a portion of the first and second sides of the bottom fitted sheet at first and second side attachment segments. Tags may also be affixed at the ends of the side attachment segments to the top flat sheet and bottom fitted sheet. In another embodiment of the present invention, a blanket may be magnetically held in place at the foot-end of the top flat sheet and bottom fitted sheet.

DESCRIPTION OF THE INVENTION

Figure 1A:
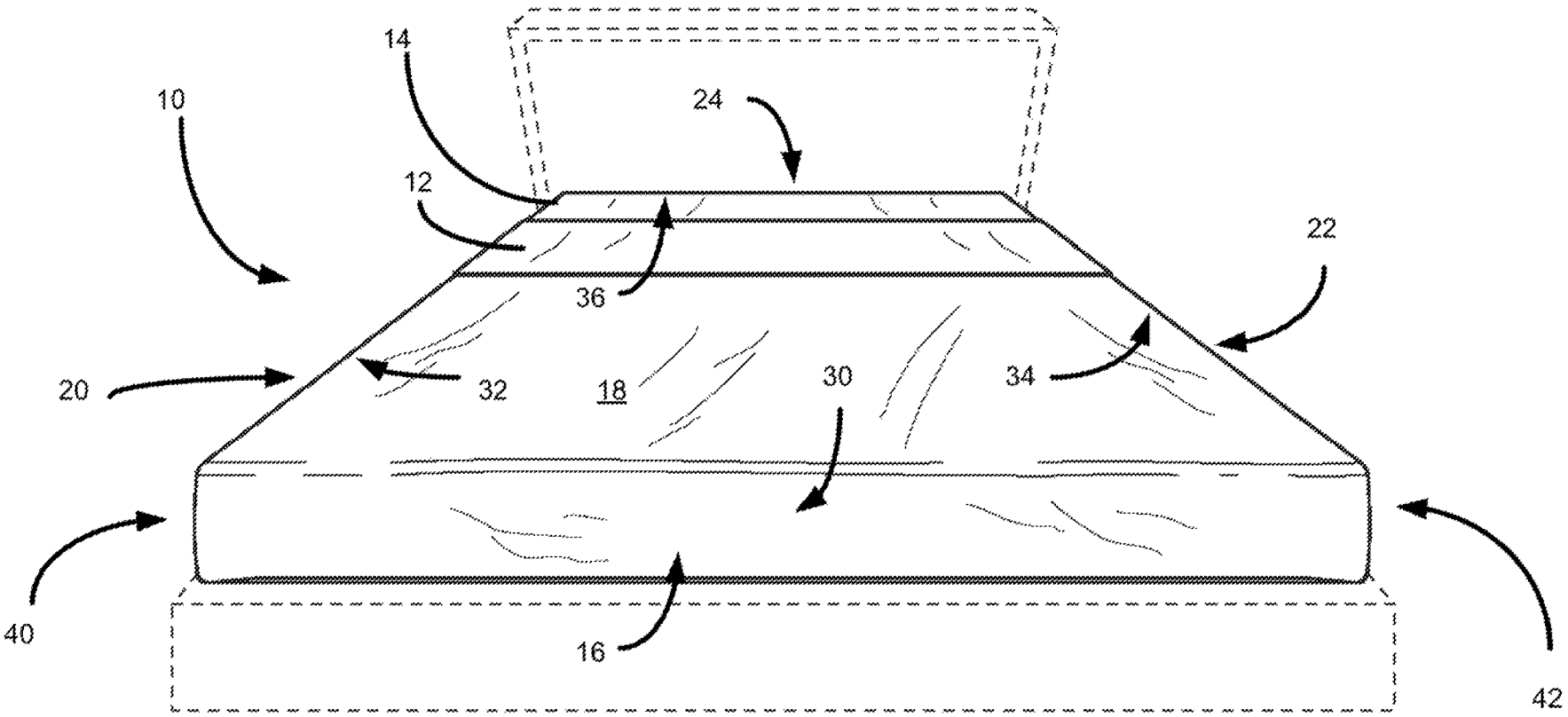
FIG. 1A is a front view of the top flat sheet/bottom fitted sheet combination with the top sheet partially folded down.
Figure 1B:
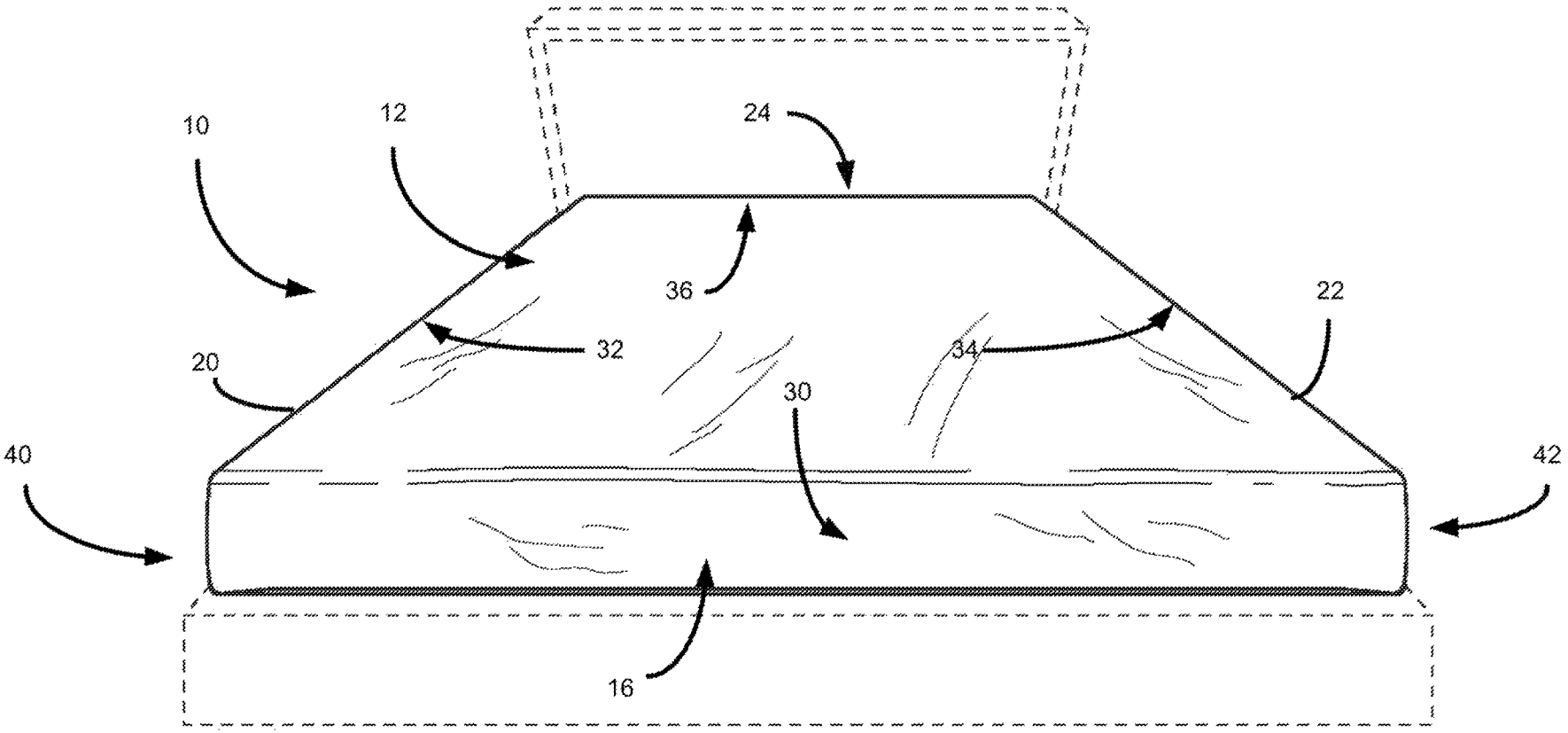
FIG. 1B is a front view of the top flat sheet/bottom fitted sheet combination.

The present invention is a top flat sheet/bottom fitted sheet combination 10 for use as bed linen in one embodiment of the present invention. FIG. 1A is a front view of the top flat sheet/bottom fitted sheet combination 10 with a top flat sheet 12 partially folded down. FIG. 1B is a front view of the top flat sheet/bottom fitted sheet combination 10 of FIG. 1A. The top flat sheet/bottom fitted sheet combination 10 includes the top flat sheet 12 attached to a bottom fitted sheet 14 on a foot 16 of a mattress 18. The mattress is typically rectangular and includes the foot 16, two mattress sides 20 and 22, and a mattress top end 24. Likewise, the top flat sheet/bottom fitted sheet combination 10 is sized and shaped to fit the mattress 18. The bottom fitted sheet 14 includes a foot-end 30, two sides 32 and 34, and a top edge 36.

Figure 2:
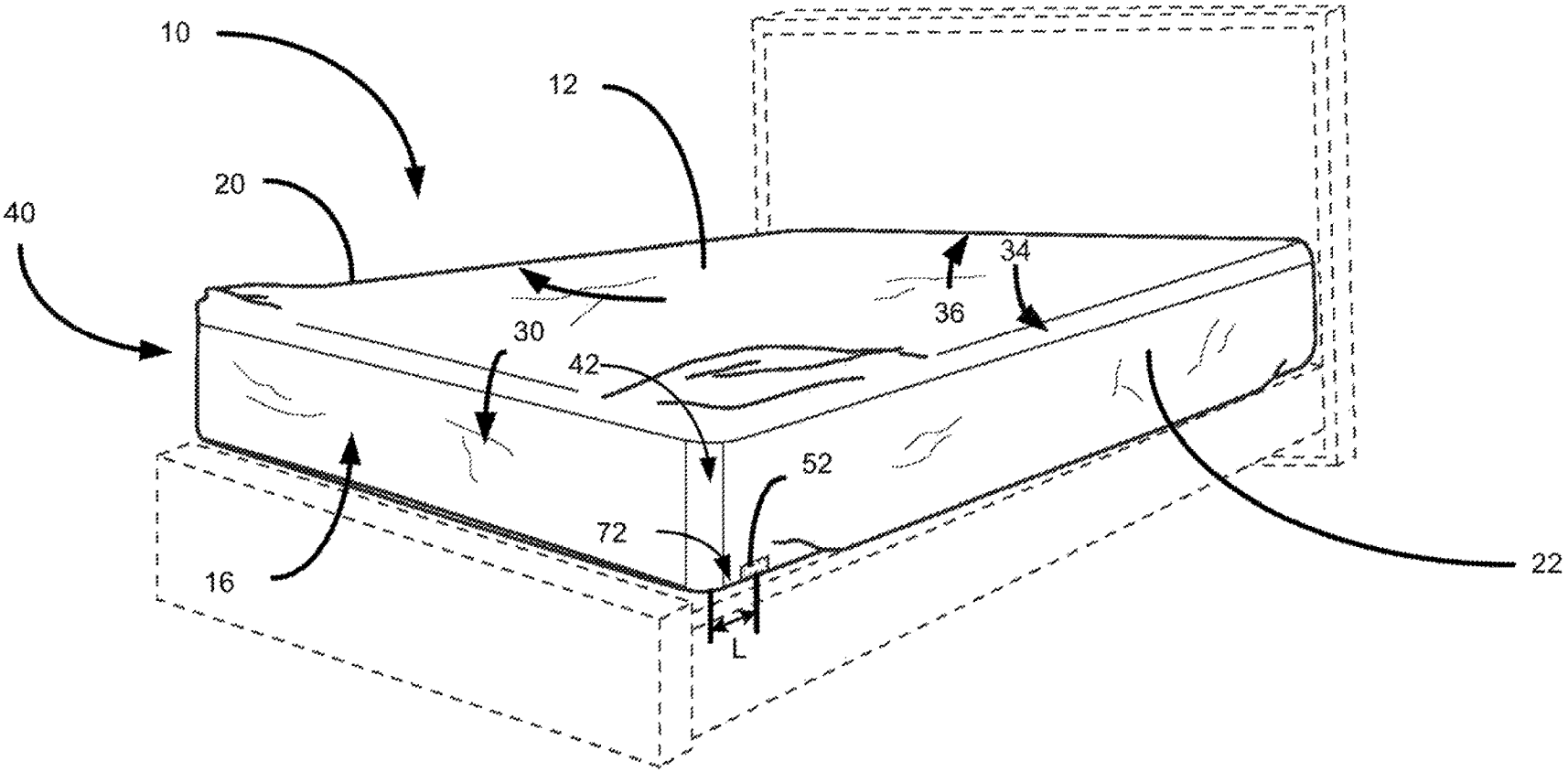
FIG. 2 is a frontal side view of the top flat sheet/bottom fitted sheet combination.
Figure 3:
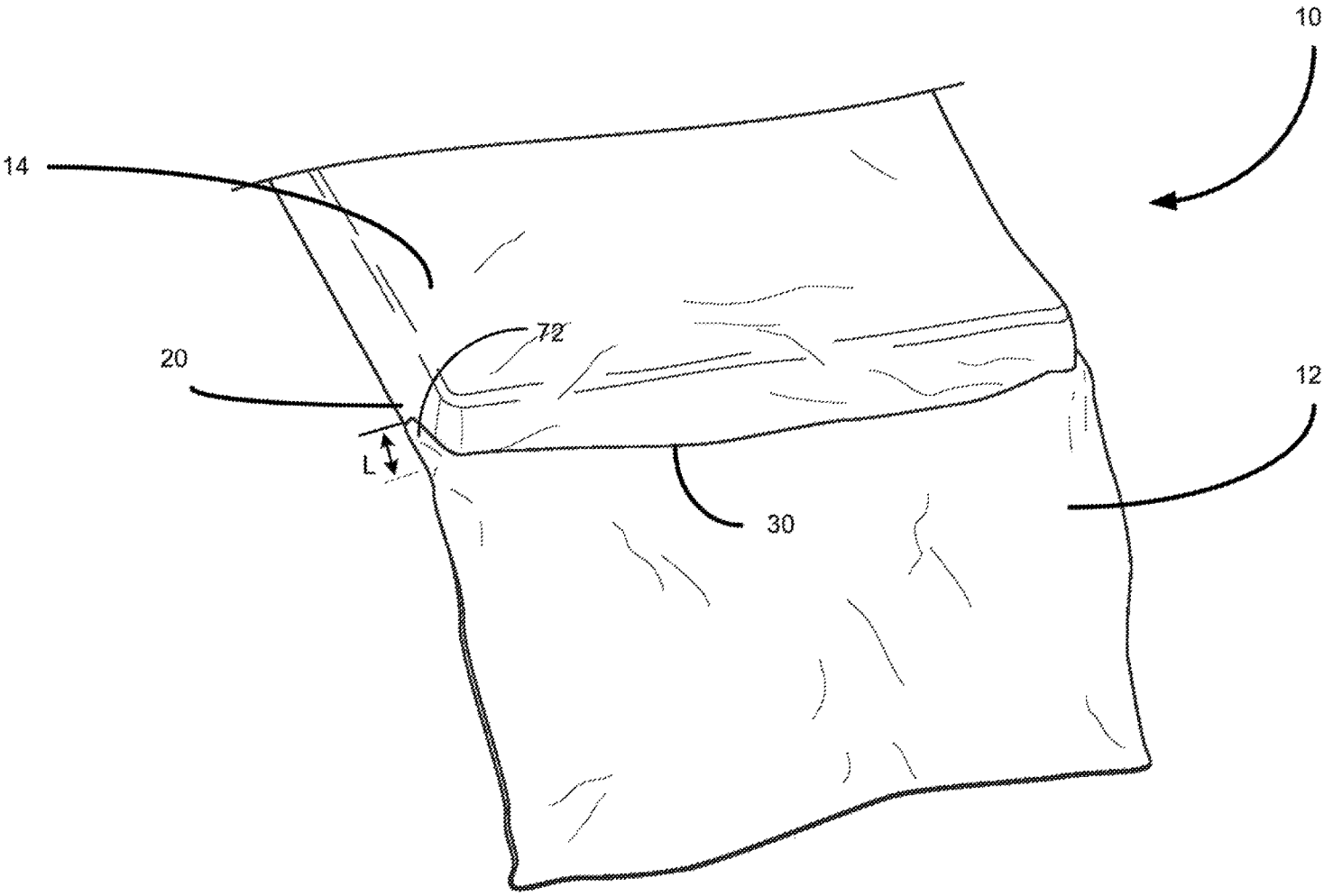
FIG. 3 is a top view of the top flat sheet/bottom fitted sheet combination with the top sheet pulled away from the fitted sheet.

FIG. 2 is a frontal side view of the top flat sheet/bottom fitted sheet combination 10. FIG. 3 is a top view of the top flat sheet/bottom fitted sheet combination 10 with the top flat sheet 12 pulled away from the bottom fitted sheet 14. The bottom fitted sheet is similar to a conventional fitted sheet in that the fitted sheet is elasticated on a portion of its edge and shaped to fit tightly over a mattress. The top flat sheet 12 is also similar to a conventional flat sheet. The top flat sheet 12 is attached to the bottom fitted sheet 14 at the foot-end 30. Additionally, the top flat sheet is further attached to the bottom fitted sheet on a portion of the sides 32 and 34 at side attachment segments 70 and 72. The side attachment segments 70 and 72 may be of any length L covering a portion of the sides 32 and 34. Preferably, the side attachment lengths L are 4 to 12 inches in length measuring from the corners 40 and 42 to the tags 50 and 52.

Figure 4:
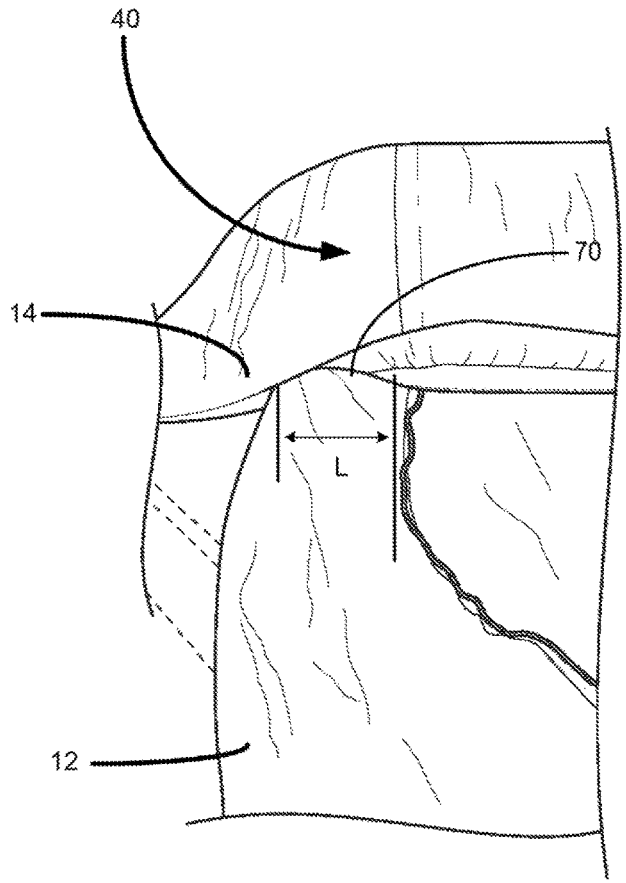
FIG. 4 is an isolated front view of a left corner of the top flat sheet/bottom fitted sheet combination with the top flat sheet pulled away from the bottom fitted sheet.
Figure 5:
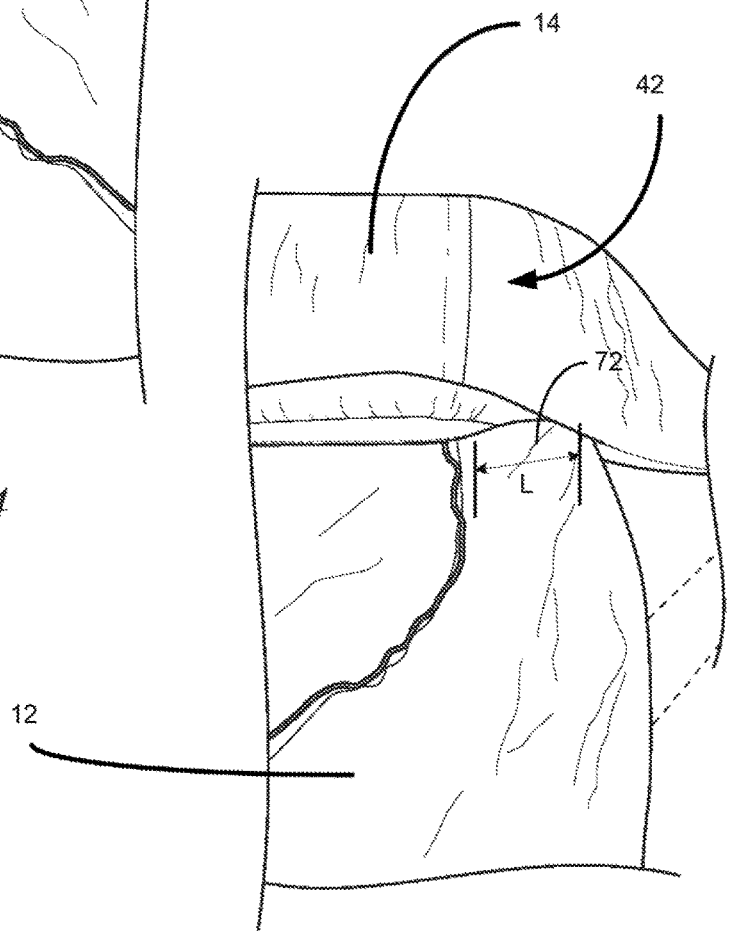
FIG. 5 is an isolated front view of a right corner opposite the left corner of the top flat sheet/bottom fitted sheet combination with the top flat sheet pulled away from the bottom fitted sheet.

FIG. 4 is an isolated front view of the left corner 40 of the top flat sheet/bottom fitted sheet combination 10 with the top flat sheet 12 pulled away from the bottom fitted sheet 14. FIG. 5 is an isolated front view of the right corner 42 opposite the left corner 40 of the top flat sheet/bottom fitted sheet combination 10 with the top flat sheet 12 pulled away from the bottom fitted sheet 14.

Figure 6:
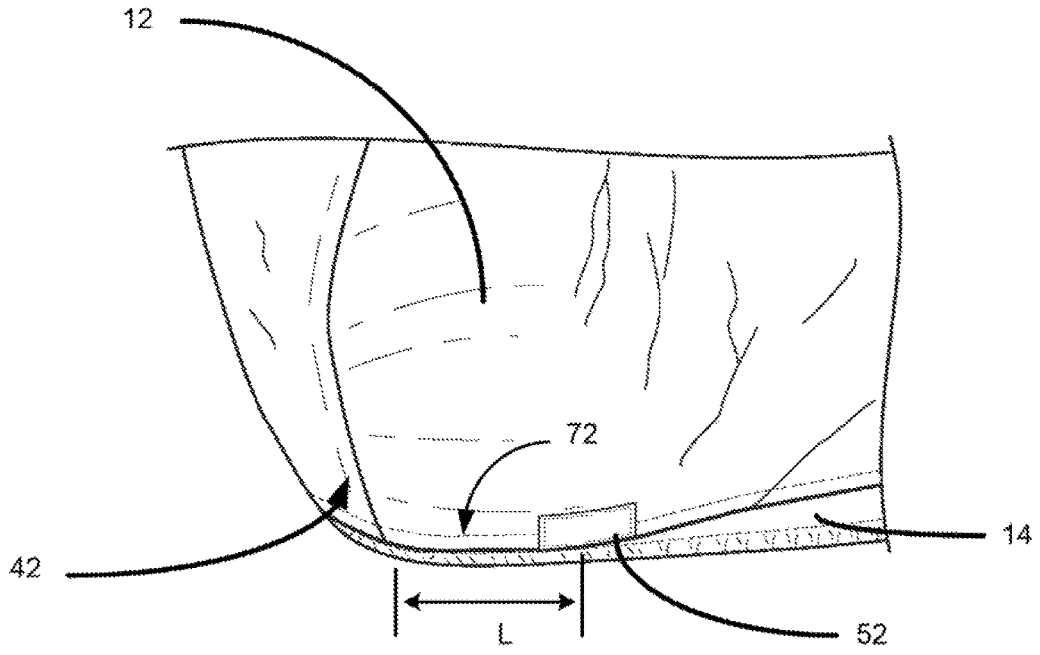
FIG. 6 is an isolated front view of the right corner of the top flat sheet/bottom fitted sheet combination illustrating a right tag connecting the top flat sheet with the bottom fitted sheet.
Figure 7:
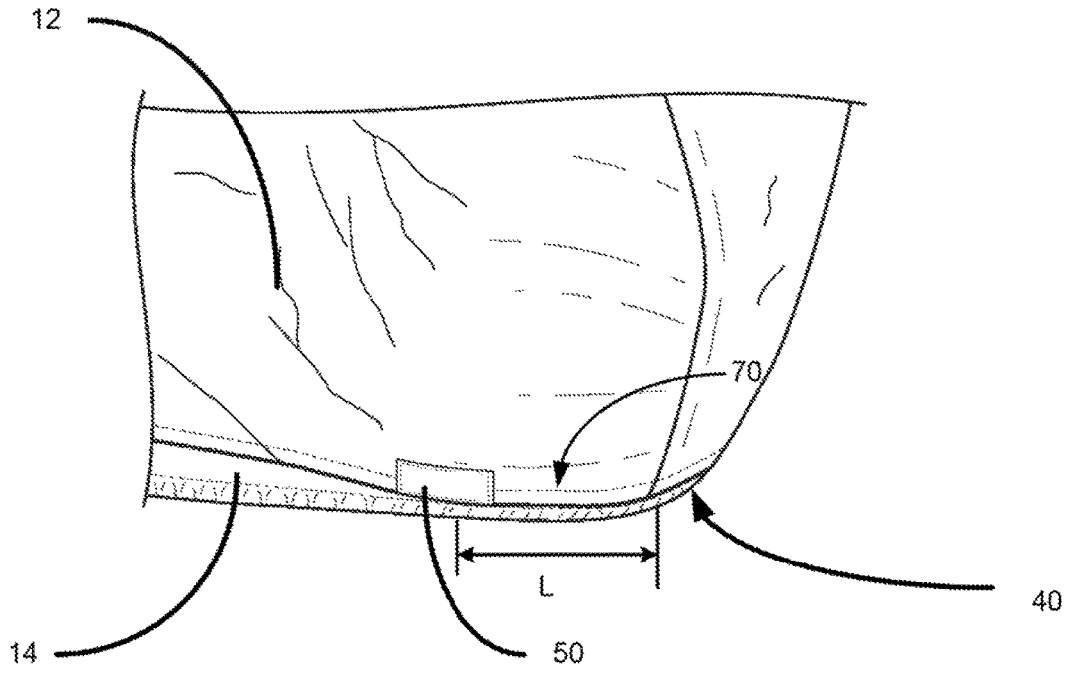
FIG. 7 is an isolated front view of the left corner of the top flat sheet/bottom fitted sheet combination illustrating a left tag connecting the top flat sheet with the bottom fitted sheet.

FIG. 6 is an isolated front view of the right corner 42 of the top flat sheet/bottom fitted sheet combination 10 illustrating a right tag 52 connecting the top flat sheet 12 with the bottom fitted sheet 14. FIG. 7 is an isolated front view of the left corner 40 of the top flat sheet/bottom fitted sheet combination 10 illustrating a left tag 50 connecting the top sheet with the fitted sheet. The top flat sheet 12 may be connected to the bottom fitted sheet 14 in any fashion such as with stitching, pins, or other fastening mechanisms. Preferably, the top sheet is connected with the bottom fitted sheet with stitching running the full width or sporadically of the foot-end 30 edge and a portion of the length L around the corners 50 and 52 onto the sides 32 and 34 as depicted in FIGS. 6 and 7 as side attachment segments 70 and 72. A key connection point on both sides of the top flat sheet/bottom fitted sheet combination 10 are the tags 50 and 52. The tags may be dimensioned in any size, but in one embodiment, the tag is 0.75 inches in height and 1.5 inches in width. The tags 50 and 52 are stitched onto the top flat sheet/bottom fitted sheet combination 10 at the final stitching length on the sides 32 and 34 of the top flat sheet/bottom fitted sheet combination 10 at the end of the side attachment segments 70 and 72. Preferably, each tag may be stitched on the top flat sheet 12 and bottom fitted sheet 14 with two rows of stitching.

Each tag provides unique features not found in existing bedding. First, the tag provides at least four extra lines of stitching at the end of the side attachment segments 70 and 72 between the top flat sheet and bottom fitted sheet, thereby reinforcing the attachment between the top flat sheet to the bottom fitted sheet. The stitching, unlike existing bedding where the fitted sheet and flat sheet are connected, has stitching running a small length L (preferably between 4 and 12 inches) on each side 32 and 34 of the top flat sheet/bottom fitted sheet combination 10. With this additional stitching found in both on a portion of the sides of the top flat sheet/bottom fitted sheet combination 10 and the tags 50 and 52 provides a more secure attachment mechanism, thus providing durability in maintaining the attachment in the top flat sheet/bottom fitted sheet combination 10 not found in existing bedding. Additionally, a problem with existing bedding is that the fitted sheet is often incorrectly positioned 90 degrees off from correct placement. In these situations, the user oftentimes must first place the fitted sheet orientated one way only to find that it is incorrect, which requires the re-orientating of the fitted sheet by a 90-degree rotation. The tags resolves this problem by providing a way to identify the foot-end of the top flat sheet/bottom fitted sheet combination 10, thereby enabling the user to correctly position the top flat sheet/bottom fitted sheet combination 10 on the bed on the user's first attempt. The user only needs to identify the two tags and position the top flat sheet/bottom fitted sheet combination 10 with the two tags at the bottom two corners 40 and 42. By connecting the top flat sheet 12 with the bottom fitted sheet 14, it provides an additional advantage in preventing kicking the top flat sheet off the bed when a user or users are in the bed.

Figure 8:
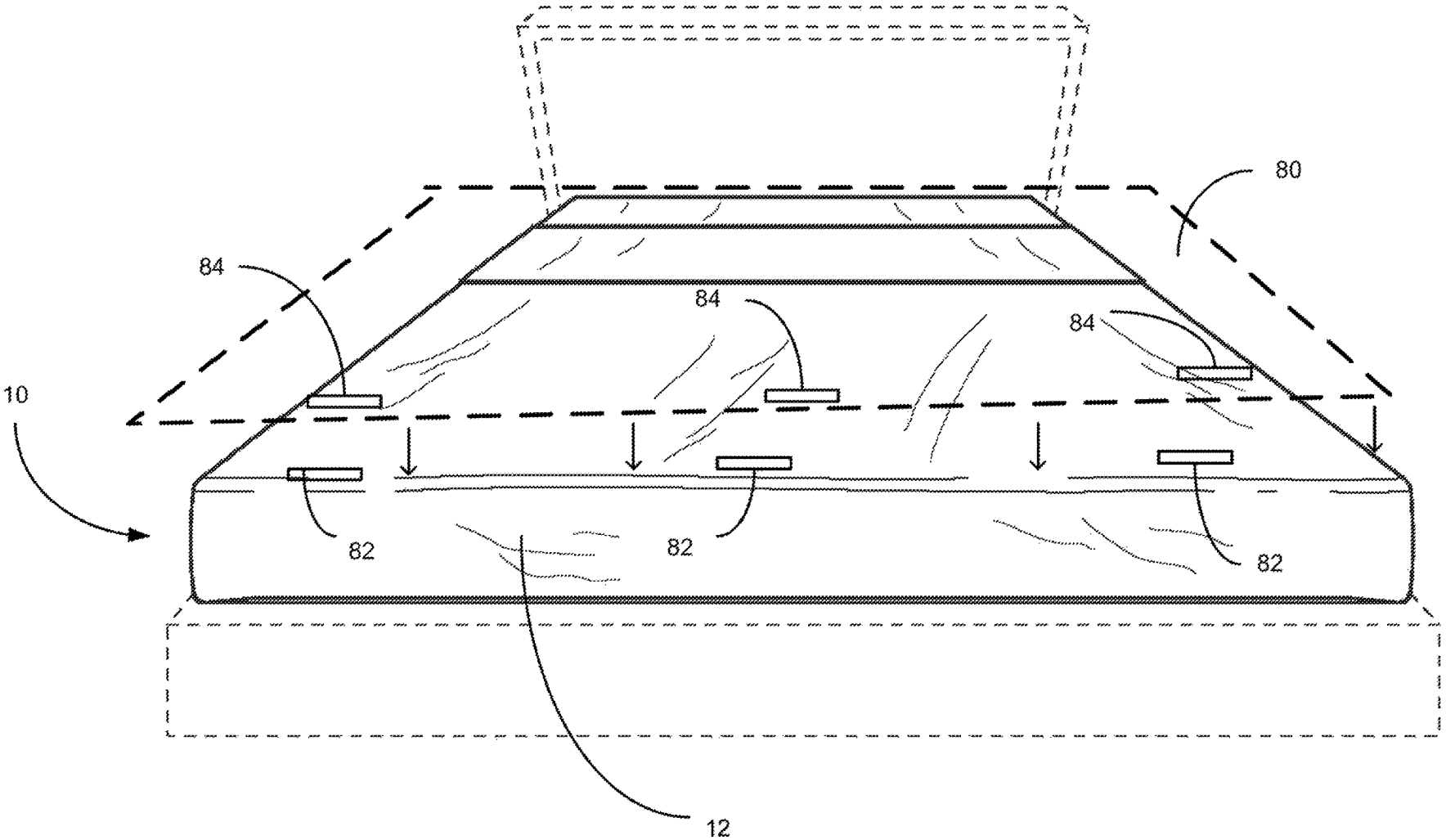
FIG. 8 is a front view of the top flat sheet/bottom fitted sheet combination with a blanket.

In another embodiment of the present invention, a blanket 80 may be magnetically held in place with the top flat sheet/bottom fitted sheet combination 10. FIG. 8 is a front view of the top flat sheet/bottom fitted sheet combination 10 with the blanket 80. At the foot-end of the top flat sheet/bottom fitted sheet combination 10, a plurality of strips 82 comprising either magnets or strips of metal may be positioned on any portion of the top flat sheet 12 or the bottom fitted sheet 14. The foot-end of the blanket 80 may have corresponding strips 84 comprising either of magnets for use with strips of metal in the top flat sheet/bottom fitted sheet combination 10 or strips of metal where magnets are used on the top flat sheet/bottom fitted sheet combination 10. The blanket 80 may be positioned over the top flat sheet/bottom fitted sheet combination 10 with the magnets and strips of metal holding the blanket in place against the top flat sheet/bottom fitted sheet combination 10.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teachings will recognize additional modifications, applications, and embodiments within the scope thereof.

It is therefore intended by the appended claims to cover any and all such applications, modifications, and embodiments within the scope of the present invention.

What is claimed is:

1. A bed linen combination for use on a mattress, the combination comprising:

a bottom fitted sheet sized and shaped to cover the mattress, the bottom fitted sheet having a first side, an opposing second side, a top edge, and a foot-end; and a top flat sheet sized and shaped to cover the mattress;

wherein the top flat sheet is attached to the bottom fitted sheet at the foot-end and a portion of the first and second sides of the bottom fitted sheet;

wherein the too flat sheet is attached to the bottom fitted sheet at a portion of the first side at a first side attachment segment;

wherein the top flat sheet is attached to the bottom fitted sheet at a portion of the second side at a second side attachment segment;

wherein a first tag is affixed at an end of the first side attachment segment to the top flat sheet and the bottom fitted sheet; and wherein a second tag is affixed at an end of the second side attachment segment to the top flat sheet and the bottom fitted sheet;

wherein the first and second tags reinforce the attachment of the top flat sheet to the bottom fitted sheet.

2. The combination according to claim 1 wherein:

the top flat sheet is affixed to the bottom fitted sheet with stitching; and the first and second tags are affixed to the top flat sheet and the bottom fitted sheet with stitching.

3. The combination according to claim 1 wherein the top flat sheet is affixed to the bottom fitted sheet with stitching.

4. The combination according to claim 1 further comprising a blanket affixed to the foot-end of the top flat sheet.

5. The combination according to claim 4 wherein the blanket is affixed to the top flat sheet by utilizing a magnetic mechanism affixed to the blanket and the top flat sheet.

6. The combination according to claim 1 further comprising a blanket affixed to the foot-end of the bottom fitted sheet.

7. The combination according to claim 6 wherein the blanket is affixed to the bottom fitted sheet by utilizing a magnetic mechanism affixed to the blanket and the bottom fitted sheet.

8. A bed linen combination for use on a mattress, the combination comprising:

a bottom fitted sheet sized and shaped to cover the mattress, the bottom fitted sheet having a first side, an opposing second side, a top edge, and a foot-end; and a top flat sheet sized and shaped to cover the mattress;

wherein the top flat sheet is attached to the bottom fitted sheet at the foot-end and a portion of the first and second sides of the bottom fitted sheet;

wherein the top flat sheet is attached to the bottom fitted sheet at a portion of the first side at a first side attachment segment;

wherein the top flat sheet is attached to the bottom fitted sheet at a portion of the second side at a second side attachment segment;

wherein a first tag is affixed at an end of the first side attachment segment to the top flat sheet and the bottom fitted sheet;

wherein a second tag is affixed at an end of the second side attachment segment to the top flat sheet and the bottom fitted sheet.

* * * * *